US011530494B2

(12) United States Patent
Funakoshi et al.

(10) Patent No.: US 11,530,494 B2
(45) Date of Patent: Dec. 20, 2022

(54) SPINNERET AND METHOD FOR MANUFACTURING FIBER WEB

(71) Applicant: Toray Industries, Inc., Tokyo (JP)

(72) Inventors: Joji Funakoshi, Otsu (JP); Taku Yamamoto, Otsu (JP); Tomoki Tamura, Otsu (JP); Yasunori Kanemori, Otsu (JP)

(73) Assignee: TORAY INDUSTRIES, INC., Tokyo (JP)

( * ) Notice: Subject to any disclaimer, the term of this patent is extended or adjusted under 35 U.S.C. 154(b) by 219 days.

(21) Appl. No.: 17/046,026

(22) PCT Filed: Mar. 8, 2019

(86) PCT No.: PCT/JP2019/009539
§ 371 (c)(1),
(2) Date: Oct. 8, 2020

(87) PCT Pub. No.: WO2019/198397
PCT Pub. Date: Oct. 17, 2019

(65) Prior Publication Data

US 2021/0025078 A1 Jan. 28, 2021

(30) Foreign Application Priority Data

Apr. 11, 2018 (JP) ..... JP2018-075939

(51) Int. Cl.
*D01D 4/02* (2006.01)
*D04H 1/732* (2012.01)

(52) U.S. Cl.
CPC ..... *D01D 4/02* (2013.01); *D04H 1/732* (2013.01)

(58) Field of Classification Search
CPC ..... D01D 4/02; D01D 4/08; D04H 1/732; D04H 1/736; D04H 3/16
See application file for complete search history.

(56) References Cited

U.S. PATENT DOCUMENTS 6,164,950 A * 12/2000 Barbier ..... D01D 5/082 425/382.2
2008/0290551 A1 11/2008 Takatani et al.
(Continued)

FOREIGN PATENT DOCUMENTS

CN 2216070 Y 12/1995
CN 201128786 Y 10/2008
(Continued)

OTHER PUBLICATIONS

Chinese Office Action for Chinese Application No. 201980022059.1, dated Dec. 23, 2021, with translation, 11 pages.
(Continued)

*Primary Examiner* — Xiao S Zhao
*Assistant Examiner* — Joseph S Leyson
(74) *Attorney, Agent, or Firm* — RatnerPrestia

(57) ABSTRACT

A spinneret includes: a plate including a plurality of nozzle holes formed therein. In the plates, the plurality of nozzle holes are formed in a substantially rectangular area on a principal surface, the rectangular area includes a non-forming zone that intersects with nozzle hole rows, the non-forming zone continuously extending from one long side of the rectangle to the other long side, and the non-forming zone including no nozzle holes, in nozzle hole rows with which the non-forming zone intersects out of the nozzle hole rows, in each of the nozzle hole rows, the nozzle hole is not formed on a part where the non-forming zone intersects with a position of the regular interval at which the nozzle holes are aligned, and the nozzle hole corresponding to number of the unformed nozzle holes is additionally formed in a short side direction of the nozzle hole row.

14 Claims, 10 Drawing Sheets

(56) References Cited

U.S. PATENT DOCUMENTS

| | | | | |
|---|---|---|---|---|
| 2009/0104301 | A1 | 4/2009 | Birkholz et al. | |
| 2015/0376815 | A1* | 12/2015 | Kotera | D21H 13/18 425/464 |
| 2018/0051391 | A1 | 2/2018 | Kotera et al. | |
| 2021/0230773 | A1* | 7/2021 | Wang | D01D 4/06 |

FOREIGN PATENT DOCUMENTS

| | | | |
|---|---|---|---|
| CN | 101443489 | A | 5/2009 |
| CN | 201268732 | Y | 7/2009 |
| CN | 102021664 | A | 4/2011 |
| CN | 102127820 | A | 7/2011 |
| CN | 103741227 | A | 4/2014 |
| CN | 107488878 | A | 12/2017 |
| JP | 63235522 | A | 9/1988 |
| JP | 02112409 | A | 4/1990 |
| JP | 11302918 | A | 11/1999 |
| JP | 2000328347 | A | 11/2000 |
| JP | 2003138464 | A | 5/2003 |
| JP | 2011063926 | A | 3/2011 |
| JP | 2014177734 | A | 9/2014 |
| WO | 03014423 | A1 | 2/2003 |
| WO | 2014133006 | A1 | 9/2014 |

OTHER PUBLICATIONS

Extended European Search Report for European Application No. 19 785 494.6, dated Dec. 8, 2021, 5 pages.

International Search Report and Written Opinion for International Application No. PCT/JP2019/009539, dated Jun. 11, 2019, 5 pages.

* cited by examiner

SPINNERET AND METHOD FOR MANUFACTURING FIBER WEB

CROSS REFERENCE TO RELATED APPLICATIONS

This is the U.S. National Phase application of PCT/JP2019/009539, filed Mar. 8, 2019, which claims priority to Japanese Patent Application No. 2018-075939, filed Apr. 11, 2018, the disclosures of these applications being incorporated herein by reference in their entireties for all purposes.

FIELD OF THE INVENTION

The present invention relates to a spinneret and a method for manufacturing a fiber web using the spinneret.

BACKGROUND OF THE INVENTION

As a general method for manufacturing a fiber web, a chip that is a raw material is extruded by an extruder so as to be defined as a polymer, and the polymer is guided to a spinning pack through piping for a polymer installed in a heating box. After that, the guided polymer passes through a filtering medium filter arranged in the spinning pack so as to remove a foreign matter in the polymer, is distributed on a porous plate, and is discharged from nozzle holes of a spinneret. After that, the polymer passes through a stretching process, a fiber web is formed on a collection net, and the polymer is finally wound as a sheet.

In the spinneret, the multiple nozzle holes are bored, and, in recent years, productivity is improved by: (i) further increasing the number of nozzle holes; and (ii) widening the spinneret itself.

Arrangement of multiple nozzle holes of (i) is required to closely bore nozzle holes up to a processing limit and to closely arrange the nozzle holes. As for a problem occurring at that time, for example, Patent Literature 1 discloses that a part of a discharge surface of a spinneret is defined as a non-hole area where nozzle holes are not bored. This is a technique that a center part of a spinneret discharge surface is defined as a non-hole area and both right and left sides across the center part are defined as hole areas where nozzle holes are bored. In this manner, an ascending current caused by an associated flow along with yarn traveling is easily formed in the non-hole area, and a small amount of inert gas is easily directed to the vicinity of the spinneret surface by this ascending current, in other words, the spinneret surface can be favorably sealed by the inert gas.

In addition, Patent Literature 2 discloses a technique that the spinneret is a spinneret for wet spinning, but a part of the spinneret discharge surface thereof is defined as a missing area where nozzle holes directed from one long side to the other long side and extending in a direction perpendicular to a long side direction are not formed. In this manner, a congealed liquid current is supplied up to the center part of the spinneret so as to obtain a fiber reducing variation between single yarns without lowering productivity.

As for the widening of the spinneret of (ii), considering the fact that the Reifenhauser Company (Germany) as a large equipment manufacturer of spunbond put out a news release for a spinning machine having a width of 5.2 m in April of 2017, a supersized spinneret having a width of 3 m or more becomes mainstream, and further widening is required from now on.

PATENT LITERATURE

Patent Literature 1: Japanese Laid-open Patent Publication No. 2003-138464

Patent Literature 2: Japanese Laid-open Patent Publication No. S63-235522

SUMMARY OF THE INVENTION

As for the widening of the spinneret of (ii), when a large spinneret having a very wide width, in particular, a large spinneret having a width of 3 m or more, is produced, an expensive long processing machine is required, and production costs of the spinneret are expensive. This kind of long processing machine requires a very long time to produce one spinneret.

Patent Literature 1 and Patent Literature 2 disclose a method for solving a problem when nozzle holes are closely arranged as described above, but do not disclose any specific methods for manufacturing a spinneret having a wide width.

The present invention provides a spinneret that has a wide width and yet can be produced inexpensively using a general-purpose processing machine that is relatively inexpensive and is able to be introduced. In addition, the present invention provides a spinneret that can be produced in a short time using a plurality of general-purpose processing machines simultaneously. Furthermore, the present invention provides a spinneret that can be produced with a desired width because a width of the spinneret is not subject to the restriction of a width of a processing machine.

(1) To solve the above-described problem, a first spinneret according to the present invention includes: a plate including a plurality of nozzle holes formed therein; or a plurality of the plates stacked one another in a spinning direction, wherein, in at least one of the plates, the plurality of nozzle holes are formed in a substantially rectangular area on a principal surface, nozzle hole rows are aligned at regular intervals in a long side direction of the rectangle, each of the nozzle hole rows including the plurality of nozzle holes aligned at regular intervals in a short side direction of the rectangle, the rectangular area includes a non-forming zone that intersects with the nozzle hole rows, the non-forming zone continuously extending from one long side of the rectangle to the other long side, and the non-forming zone including no nozzle holes, in nozzle hole rows with which the non-forming zone intersects out of the nozzle hole rows, in each of the nozzle hole rows, the nozzle hole is not formed on a part where the non-forming zone intersects with a position of the regular interval at which the nozzle holes are aligned, and the nozzle hole corresponding to number of the unformed nozzle holes is additionally formed in a short side direction of the nozzle hole row, and number of nozzle holes in all of the nozzle hole rows is identical.

(2) To solve the above-described problem, a second spinneret according to the present invention includes: a plate including a plurality of nozzle holes formed therein; or a plurality of the plates stacked one another in a spinning direction, wherein, in at least one of the plates, the plurality of nozzle holes are formed in a substantially rectangular area on a principal surface, nozzle hole rows are aligned at regular intervals in a long side direction of the rectangle, each of the nozzle hole rows including the plurality of nozzle holes aligned in a short side direction of the rectangle, the rectangular area includes a non-forming zone that intersects with the nozzle hole rows, the non-forming zone continuously extending from one long side of the rectangle to the other long side, and the non-forming zone including no nozzle holes, in nozzle hole rows with which the non-forming zone does not intersect out of the nozzle hole rows, in each of the nozzle hole rows, the nozzle holes are aligned at regular intervals, in nozzle hole rows with which the non-forming zone intersects out of the nozzle hole rows, intervals of at least a part of the nozzle holes in each of the nozzle hole rows are narrower than intervals of the nozzle holes in the nozzle hole row with which the non-forming zone does not intersect, and number of nozzle holes in all of the nozzle hole rows is identical.

It is preferable for the first or the second spinneret according to the present invention to include at least one of the following features.

(3) The non-forming zone includes a division line.

(4) The plate including the non-forming zone is dividable at the division line.

(5) The plate including the non-forming zone is formed of two or more members joined together, and a join line at a join position of the adjacent two or more members on a principal surface of the plate overlaps with the non-forming zone.

(6) The division line or the join line is a straight line, and an angle (acute angle) between this line and a long side of the rectangle is a range between 30 to 70 degrees.

(7) The plate including the non-forming zone is formed by aligning two or more members at an interval, and the interval of the adjacent two or more members overlaps with the non-forming zone.

(8) The nozzle hole that is formed in the plate including the non-forming zone is defined as a nozzle hole group formed of a plurality of holes having a further small hole diameter that are gathered.

(9) A method for manufacturing a fiber web according to the present invention manufactures a fiber web using the first or the second spinneret according to the present invention.

The definition of each term according to the present invention is listed below.

A "principal surface" indicates, out of surfaces of a plate, a surface having an area much larger than those of the other surfaces.

A "long side direction" indicates a direction in which a side of a substantially rectangular area where a plurality of nozzle holes are arranged on the principal surface of a plate is long.

A "short side direction" indicates a direction in which a side of a substantially rectangular area where a plurality of nozzle holes are arranged on the principal surface of a plate is short.

A "nozzle hole row" indicates the arrangement of nozzle holes that the nozzle holes are linearly arranged toward the short side direction.

According to the present invention, a large spinneret can be produced using a general-purpose processing machine that is relatively inexpensive and is able to be introduced, so that production costs of the spinneret cab be reduced. In addition, a large spinneret can be produced in a short time using a plurality of general-purpose processing machines simultaneously. Furthermore, using a spinneret of the present invention can produce a fiber web having favorable variation in basis weight.

BRIEF DESCRIPTION OF DRAWINGS

FIG. 6(*a*) is a schematic partial plan view where a plurality of the non-forming zones are arranged, FIG. 6(*b*) is a schematic partial plan view where the non-forming zone is bent in the middle and arranged, FIG. 6(*c*) is a schematic partial plan view where the non-forming zone is bent in the middle and arranged after the direction is reversed, and FIG. 6(*d*) is a schematic partial plan view where the non-forming zone is curved and arranged.

FIG. 7(*f*) is a form where there is a division line over all of the plates, and FIG. 7(*g*) is a form where there is a division line on a part of the plates.

DETAILED DESCRIPTION OF EMBODIMENTS OF THE INVENTION

Spinneret

Figure 4:
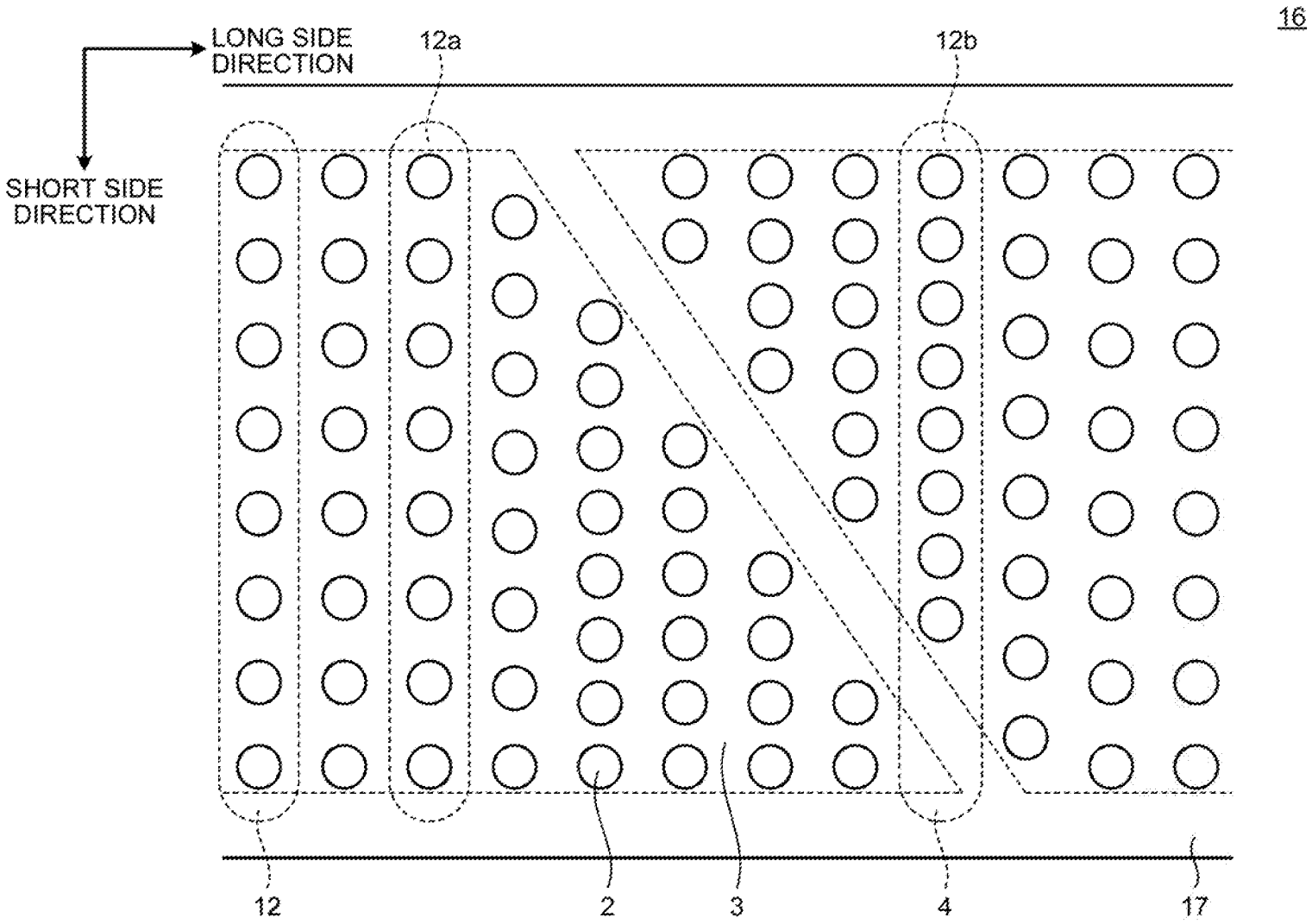
FIG. 4 is a schematic partial enlarged view illustrating the principal surface of the plate forming a first spinneret of the present invention.
Figure 5:
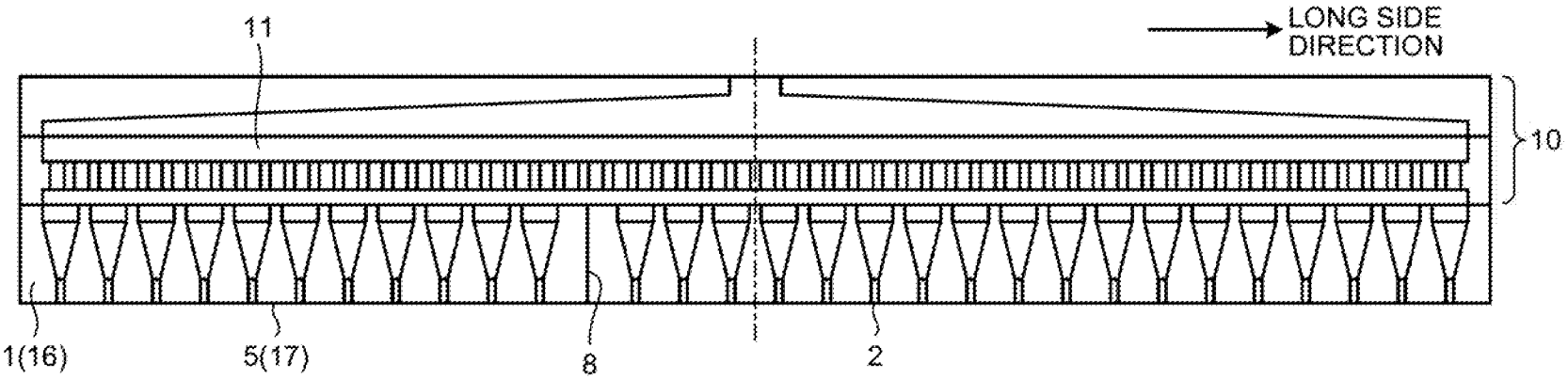
FIG. 5 is a schematic cross-sectional view illustrating the spinneret of the present invention formed of one sheet of the plate.

Embodiments of the present invention will now be described in detail with reference to the accompanying drawings. FIGS. 1 to 3 and 6 are schematic plan views illustrating various embodiments of a plate forming a spinneret according to the present invention viewed from a principal surface side. FIGS. 4, 8, 9, and 10 are schematic partial enlarged views illustrating the principal surface of the plate. FIGS. 5 and 7 are schematic cross-sectional views illustrating the spinneret of the present invention. These drawings are schematic views for correctly giving the gist of the present invention, the drawings are simplified, a spinneret 1 of the present invention is not particularly limited, and the number of plates 16, the number of forming areas 3, the number of non-forming zones 4, the number of nozzle holes 2, and a dimensional ratio thereof can be changed along with the embodiments.

Refer to FIGS. 5 and 7. FIG. 5 illustrates the spinneret 1 formed of one sheet of the plate 16, and FIG. 7 illustrate the spinneret 1 formed of a plurality of the plates 16. The spinneret 1 is fixed to the inside of a spinning pack 10, and is arranged immediately below a porous plate 11. After a polymer guided to the spinning pack 10 passes through the porous plate 11 and being discharged from the nozzle holes 2 of the spinneret 1, the polymer is cooled by a cooling apparatus (not illustrated) and is pulled as a yarn, and after that, the polymer is stacked and spread on a collection net (not illustrated) so as to form a fiber web. In this case, the cooling apparatus is installed at an opposite position across the yarn, and blows a room-temperature or temperature-controlled air current to the yarn.

Refer to FIGS. 1 to 3 and 6. In the plate 16, a principal surface 17 has a substantially rectangular area formed thereon, and the substantially rectangular area includes the forming area 3 where the nozzle holes 2 are formed and the non-forming zone 4 where the nozzle holes 2 are not formed. In the spinneret 1 formed of one sheet of the plate 16, the one principal surface 17 of the plate 16 serves as a discharge surface 5 of the spinneret 1. In the spinneret 1 formed of a plurality of the plates 16, the one principal surface 17 of the most downstream plate 16 in a spinning direction serves as the discharge surface 5 of the spinneret 1.

First Spinneret

Referring back to FIG. 4, the arrangement of the nozzle holes 2 of the plate 16 forming a first spinneret of the present invention will be described in detail. On the principal surface 17 of the plate 16, nozzle hole rows 12 each having the nozzle holes 2 aligned in a short side direction of a rectangle are aligned at regular intervals in a long side direction of the rectangle. In this rectangular area, the non-forming zone 4 where nozzle holes do not exist continuously extends from one long side of the rectangle to the other long side while intersecting with a plurality of the nozzle hole rows 12. Out of the nozzle hole rows 12, in a nozzle hole row 12*a* with which the non-forming zone 4 does not intersect, the nozzle holes 2 are aligned at regular intervals. By contrast, out of the nozzle hole rows 12, in a nozzle hole row 12*b* with which the non-forming zone 4 intersects, intervals of the nozzle holes 2 are narrower than those of the nozzle hole row 12*a* with which the non-forming zone 4 does not intersect. In this manner, the intervals of the nozzle holes 2 are narrower in the nozzle hole row 12*b*, and the number of the nozzle holes 2 in the nozzle hole row 12*b* is the same as that of the nozzle holes 2 in the nozzle hole row 12*a* even though the nozzle holes 2 do not exist in a part that intersects with the non-forming zone 4 in the nozzle hole row 12*b*. Thus, the number of the nozzle holes 2 is the same in all of the nozzle hole rows 12. FIG. 4 illustrates that the intervals of the nozzle holes 2 in the nozzle hole row 12*b* are evenly narrow, but intervals of some nozzle holes 2 alone may be narrow. In short, the number of the nozzle holes 2 in the nozzle hole row 12*b* only has to be the same as that of the nozzle holes 2 in the nozzle hole row 12*a*.

Figure 9:
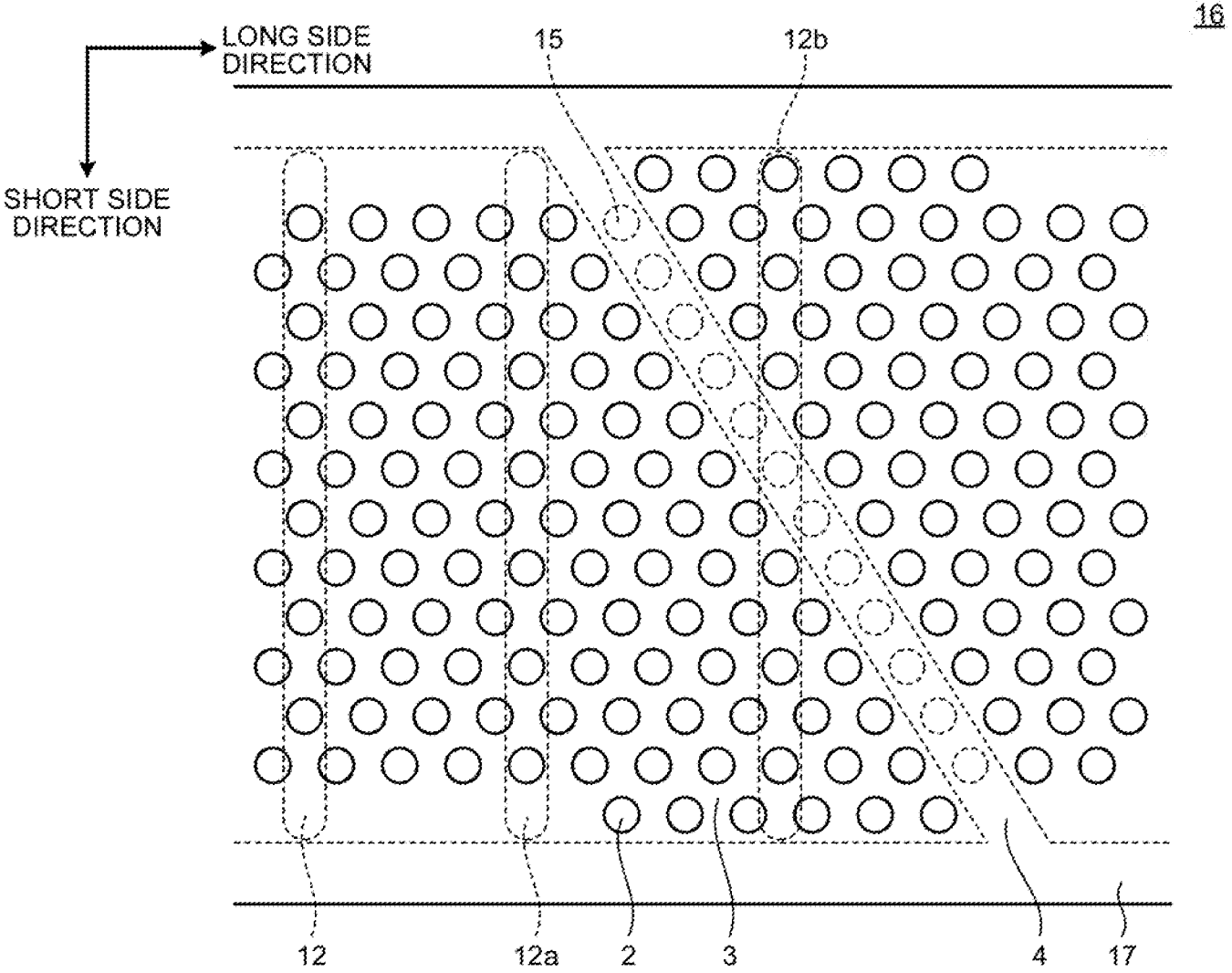
FIG. 9 is a schematic partial enlarged view illustrating the principal surface of the plate forming a second spinneret of the present invention.

The nozzle holes 2 formed on the principal surface 17 may be arranged in a lattice pattern such that the nozzle holes 2 are continuously adjacent to each other in a long side direction (see FIG. 4), and may be arranged in a zigzag pattern such that the nozzle holes 2 are skipped in a row or in a plurality of rows (see FIG. 9).

In the spinneret 1 formed of the plate 16 illustrated in FIG. 4, the number of the nozzle holes 2 is the same in each of the nozzle hole rows 12. Thus, it is possible to adjust the total discharge amount of a polymer discharged from each of the nozzle hole rows 12 when a fiber web is produced, thereby uniformizing variation in basis weight of the obtained fiber web. In addition, when yarns are cooled by a cooling apparatus installed at a position opposed to the yarns, an air current is blown to the yarns arranged in one row in the nozzle hole rows 12 in a perpendicular direction. In this case, when the number of the nozzle holes 2 is the same in each of the nozzle hole rows 12, the number of yarns is the same for each nozzle hole row 12, which makes it possible to uniformize yarn cooling for each nozzle hole row 12. Specifically, for cooling performance of the yarns, uniformizing a wind speed and a wind temperature of an air current perpendicular to the yarns is effective. Thus, adjusting the number of the yarns in the nozzle hole rows 12 can reduce variation in wind speed and wind temperature of an air current to the limit. Furthermore, adjusting the number of the nozzle holes 2 in the nozzle hole rows 12, and thus the number of yarns, causes a form of an associated flow to be adjusted for each nozzle hole row 12. Thus, the variation in wind speed and wind temperature described above is reduced. In this case, most preferably, a discharge amount of a polymer discharged from all of the nozzle holes 2 arranged in the one nozzle hole row 12 is uniformized, however, the discharge amount is not limited to this and the total discharge amount of a polymer only has to be uniformized for each nozzle hole row 12.

Figure 10:
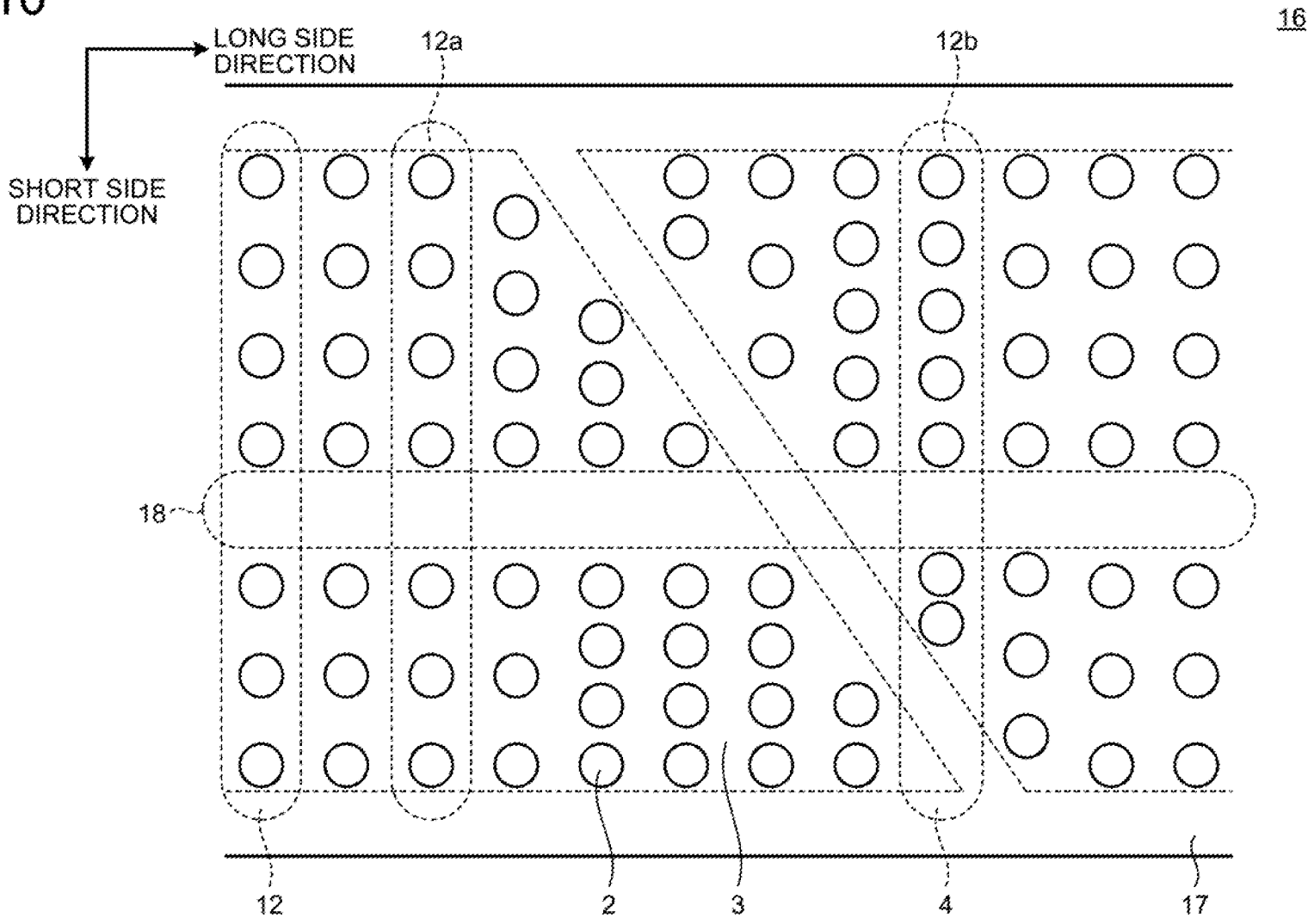
FIG. 10 is a schematic partial enlarged view illustrating the principal surface of another embodiment of the plate forming the first spinneret of the present invention.

In the nozzle hole row 12*a* with which the non-forming zone 4 does not intersect, all of the nozzle holes 2 are not necessarily aligned at regular intervals without omission. Refer to FIG. 10. As illustrated in FIG. 10, a part 18 where the nozzle hole 2 is skipped in the nozzle hole row 12*a* may exist. Except for the part 18 where the nozzle hole 2 is skipped, the nozzle holes 2 in the nozzle hole row 12 are aligned at regular intervals. The embodiment in this FIG. 10 is also defined as a fact that "in the nozzle hole row 12*a* with which the non-forming zone 4 does not intersect, the nozzle holes 2 are aligned at regular intervals in each nozzle hole row 12*a*". Even in the embodiment of FIG. 10, the number of the nozzle holes 2 in the nozzle hole row 12*a* and the number of the nozzle holes 2 in the nozzle hole row 12*b* are the same.

As described above, the plate 16 has, in a rectangular area on the principal surface 17, the non-forming zone 4 continuously extending from one long side of the rectangle to the other long side. Because the nozzle holes 2 are not formed in this non-forming zone 4, the plate 16 is dividable at the part of the non-forming zone 4. Conversely, a plate can have formation in which two or more members are aligned, and a boundary part on which these members are aligned can be defined as the non-forming zone 4. This formation will be described using the drawing.

Refer back to FIG. 2. In this plate 16, there is a division line 8 in the non-forming zone 4, and widths r1 and r2 of members 16-1 and 16-2, respectively, aligned across the division line 8 are widths that can be processed by a general-purpose processing machine. First, the nozzle holes 2 are formed on the members 16-1 and 16-2 by a general-purpose processing machine, and after that, the members 16-1 and 16-2 are aligned so as to produce a large plate 16 having a width exceeding a width that can be processed by the general-purpose processing machine. After the members 16-1 and 16-2 are aligned, joining processing may be further applied to them. As the joining processing, adjacent members are positioned with a pin, and after that, welding or diffusion joining is preferably applied to them. Or, a bolt and a screw may be used for fixing. When welding processing is applied to a whole circumference of the division line 8, the division line 8 is practically invisible on the principal surface 17, and a part where the division line 8 existed is a join line 13. Welding processing may be partially applied. In this case, the division line 8 is partially visible on the principal surface 17. The plate 16 may be dividable again by the division line 8 or may be undividable.

Refer back to FIG. 3. This plate 16 has formation in which the two members 16-1 and 16-2 are aligned at an interval 14 and this interval 14 overlaps with the non-forming zones 4.

If the position of the two members 16-1 and 16-2 can be fixed in this manner, the members are not necessarily joined. In addition, there are the two members 16-1 and 16-2 so as to exhibit the function of the plate 16. Thus, the plate 16 having formation in which the two members 16-1 and 16-2 are aligned at the interval 14 is also counted as one sheet of the plate 16.

Figure 1:
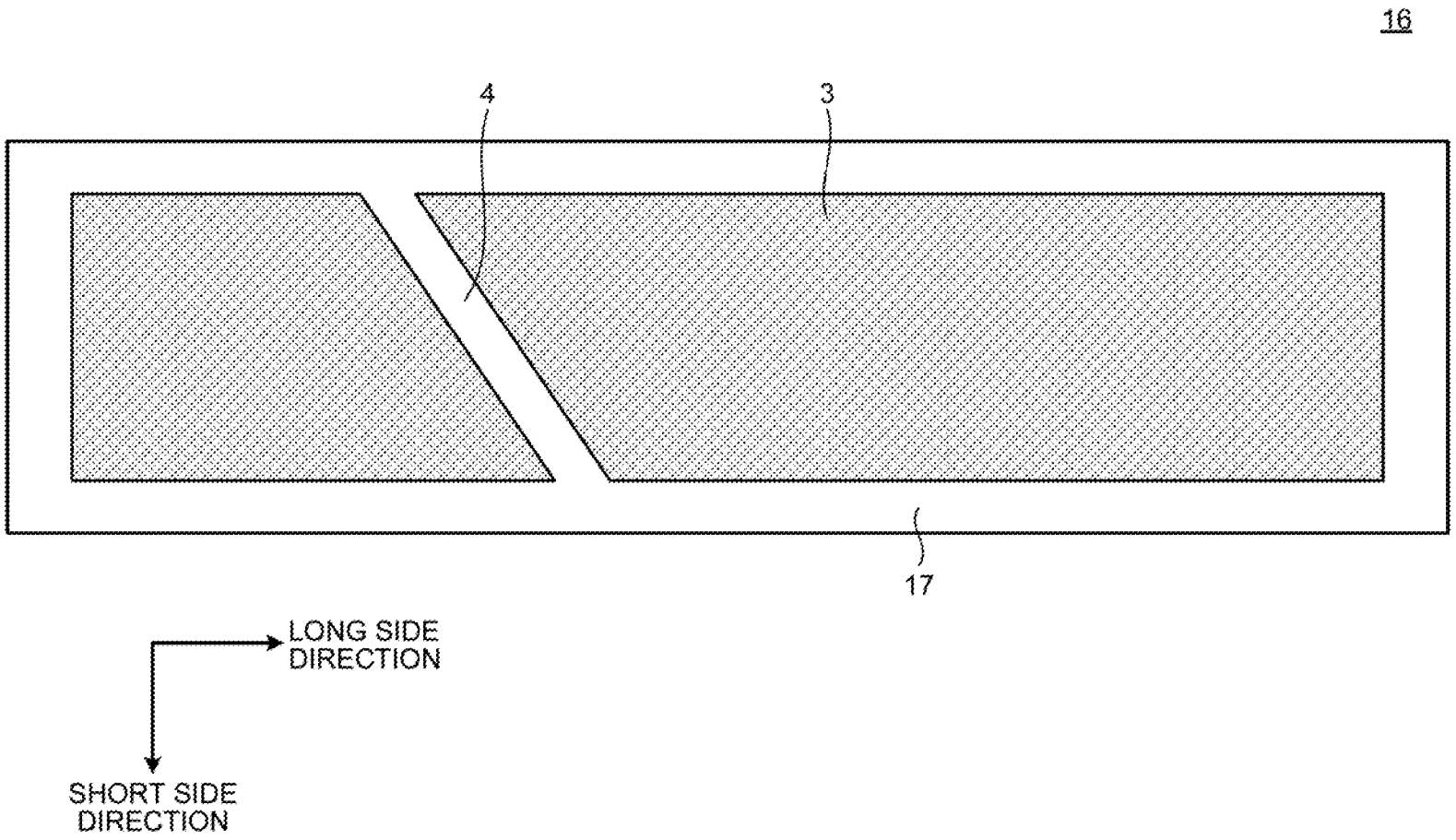
FIG. 1 is a schematic plan view illustrating a plate forming a spinneret of the present invention viewed from a principal surface side.
Figure 2:
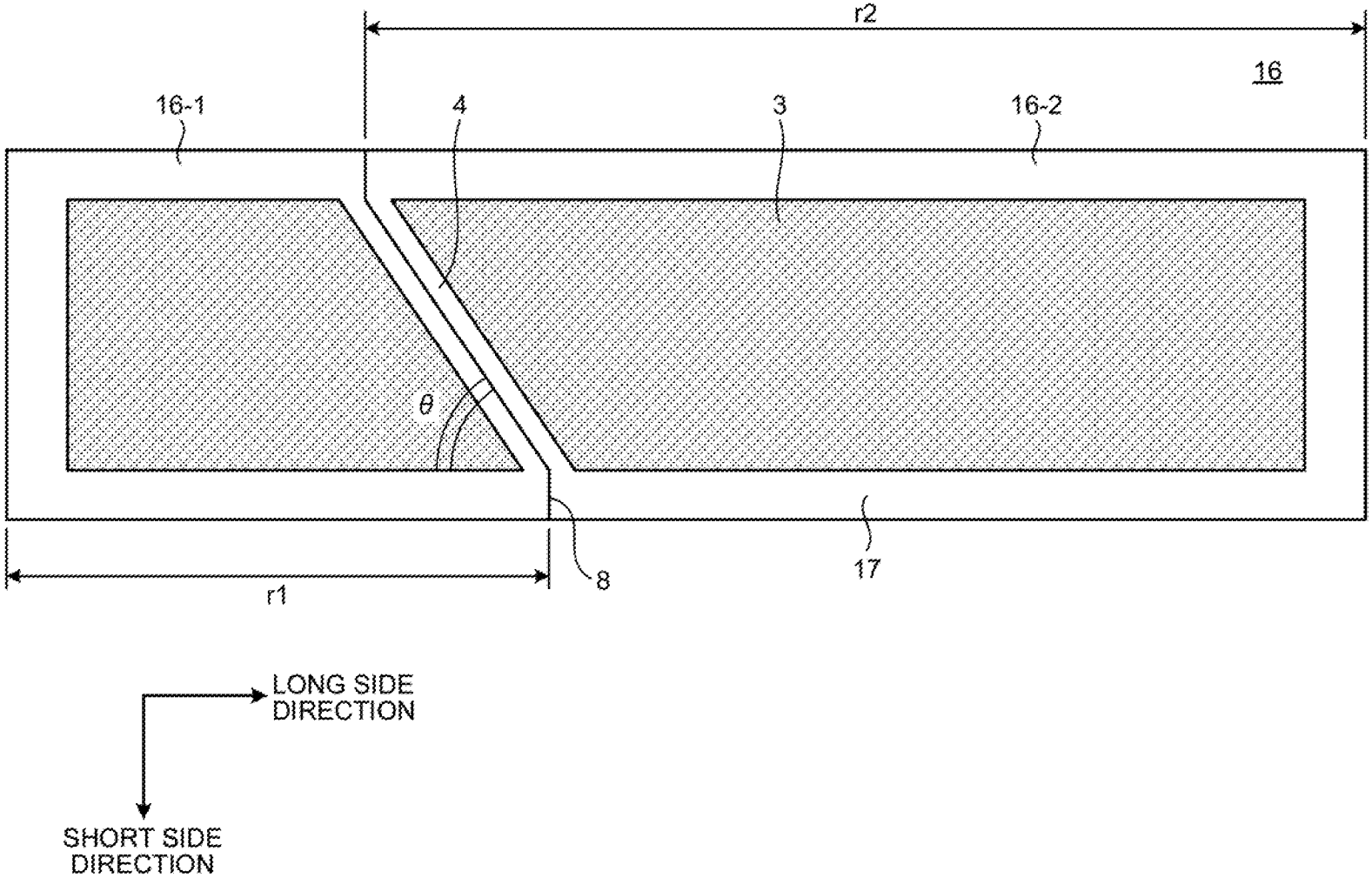
FIG. 2 is a schematic plan view illustrating another embodiment of the plate forming the spinneret of the present invention viewed from the principal surface side.
Figure 3:
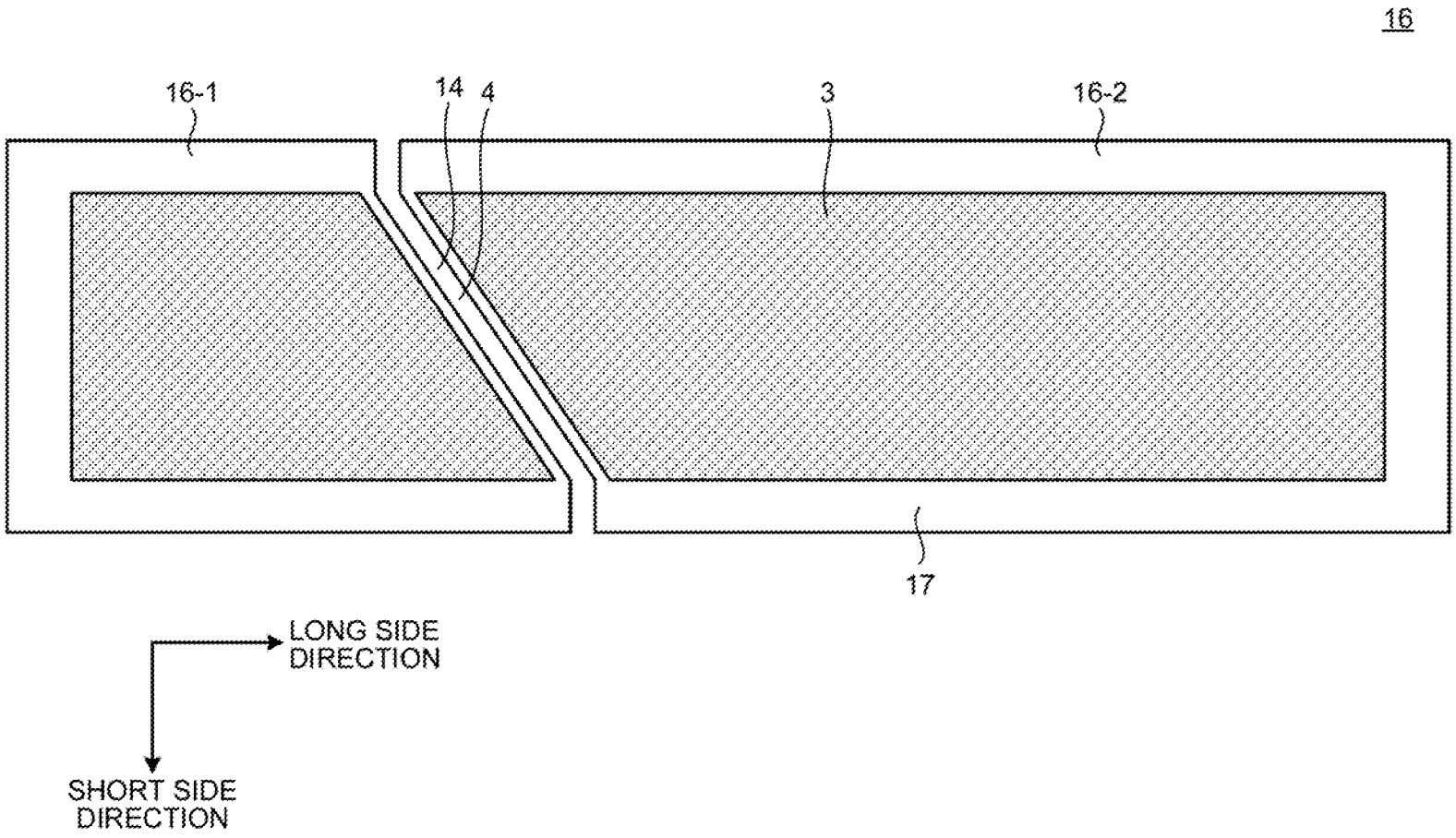
FIG. 3 is a schematic plan view illustrating yet another embodiment of the plate forming the spinneret of the present invention viewed from the principal surface side.

The plate 16 in FIGS. 2 and 3 is formed by aligning the two members 16-1 and 16-2, but the plate 16 may be formed by aligning three or more members having a width that can be processed by a general-purpose processing machine depending on a width of the spinneret 1.

In this manner, with the formation of the plate 16 according to the present invention, it is possible to produce the large plate 16 having a desirable width without being subject to the restriction of a width that can be processed by a general-purpose processing machine while boring the nozzle holes 2 by the general-purpose processing machine. In addition, the large plate 16 can be produced in a short time using a plurality of general-purpose processing machines simultaneously. Because the spinneret 1 of the present invention is formed of the plate 16 having such characteristics, the spinneret 1 can be produced with a desired width and even the large spinneret 1 can be produced in a short time.

Refer back to FIG. 2. In the plate 16 of the present invention, an angle θ (acute angle) between the division line 8 and a long side of a rectangle and an angle θ (acute angle) between the join line 13 and a long side of the rectangle when the division line 8 is practically invisible by welding processing are preferably defined as a range between 30 to 70 degrees.

As the angle θ becomes larger, in the nozzle hole row 12*b* that intersects with the non-forming zone 4, a length of a range that naturally overlaps with the non-forming zone 4, in other words, a range where the nozzle holes 2 are not formed, becomes longer and the number of the nozzle holes 2 that are not formed because of the overlapping with the non-forming zone 4 is increased. The nozzle holes 2 corresponding to the number of the nozzle holes 2 that are not formed are formed so as to be supplied to a part that does not overlap with the non-forming zone 4 in the same nozzle hole row 12*b*. However, when the number of the nozzle holes 2 that are not formed is increased excessively, intervals of nozzle holes 2 on a part that does not overlap with the non-forming zone 4 become too narrow and processing of the nozzle holes 2 becomes difficult. If the angle θ is 70 degrees or below, a range where the nozzle hole row 12*b* and the non-forming zone 4 overlap with each other is not too long, which preferably makes it easy to process the nozzle holes 2.

As the angle θ becomes smaller, a distance of the non-forming zone 4 in a long side direction becomes longer from one long side of a rectangle to the other long side. As the distance in this long side direction becomes longer, the width in a long side direction of individual members forming the plate 16 consequently becomes longer, and the width may exceed a width that can be processed by a general-purpose processing machine. If the angle θ is 30 degrees or more, the width in a long side direction of individual members is not too long and preferably falls within the width of a range that can be processed by a general-purpose processing machine.

Refer to FIG. 7. The spinneret 1 in FIG. 7 is formed of a plurality of the plates 16 stacked one another in a spinning direction. As illustrated in FIG. 7(*f*), the division line 8 may exist over all of the plates 16 stacked in a spinning direction.

When composite spinning is performed, a plurality of sheets of the plates 16 having the different number of the nozzle holes 2 are often stacked in a spinning direction. Thus, the embodiment becomes the embodiment illustrated in FIG. 7.

The spinneret 1 formed of the plates 16 stacked one another may be a spinneret in which all of the plates 16 are formed of two or more members joined together. In this case, for example, as illustrated in FIG. 7(*f*), the division line 8 exists over all of the plates 16 stacked in a spinning direction. The division line 8 in a rectangular area on the principal surface 17 of each of the plates 16 is preferably located at the same position. This is because, in order to obtain a desirable fiber cross section in the composite spinning, a plurality of polymers supplied to the nozzle holes 2 of the upper plates 16 in the spinneret 1 are divided and joined in a middle flow passage, so as to form a composite polymer flow, and the composite polymer flow is eventually supplied to the nozzle holes 2 of the lower plates 16 and is discharged from the spinneret 1. At this time, the positions of the nozzle holes 2 of the upper plate 16 and the nozzle holes 2 of the lower plate 16 in communicating flow passages in a direction normal to a polymer spinning direction are preferably close to each other as much as possible so as to reduce pressure loss of the polymers. Specifically, when a composite cross section serving as core/sheath is obtained, it is preferable that the position of the nozzle holes 2 through which a core polymer passes is adjusted in a polymer spinning direction, so as to reduce a flow passage pressure loss of a core component polymer. Thus, the division line 8 for determining the arrangement position of the nozzle holes 2 of each of the lower plates 16 is preferably the same in a spinning direction.

In addition, in the spinneret 1 formed of the plates 16 stacked one another, any of the plates 16 forming the spinneret 1 may be formed of not two or more joined members but one member. In this case, for example, as illustrated in FIG. 7(*g*), the plates 16 having the division line 8 and the plates 16 not having the division line 8 are mixed. In the spinneret 1 used for composite spinning, multiple nozzle holes 2 are bored in the plates 16 arranged at positions other than the lowest part in a spinning direction because a plurality of polymers are required to flow. By contrast, on the plate 16 arranged on the lowest part, the nozzle holes 2 for discharging a composite polymer to which a plurality of polymers are joined are bored. Thus, the number of the nozzle holes 2 may be smaller than that of the nozzle holes 2 in the plates 16 arranged on the upper part. As the number of the nozzle holes 2 that are bored in one member is smaller, a yield is higher and a reduction effect of production costs is easily obtained. Thus, each of the plates 16 arranged on the upper part is preferably formed of two or more members joined together and the number of the nozzle holes 2 bored in the individual members is preferably reduced. By contrast, in the plate 16 arranged on the lower part, the number of the nozzle holes 2 may be smaller as described above. Thus, even though a width of a member for boring the nozzle holes 2 is widened, an extremely expensive long processing machine is not required and production costs can be reduced. This is because, as characteristics of the long processing machine, processing and positional accuracy of the nozzle holes 2 are required as the number of the nozzle holes 2 bored in the principal surface per unit area becomes increased, in other words, as arrangement density of the nozzle holes 2 becomes higher, and the processing machine becomes extremely expensive. When the number of nozzle holes is small, it is possible to use a processing machine having lowered processing accuracy among long processing machines, thereby reducing production costs. In addition, if the number of the nozzle holes 2 is small, a processing delivery period is shortened even though a long processing machine is used, which makes it possible to reduce spinneret processing costs.

Figure 6:
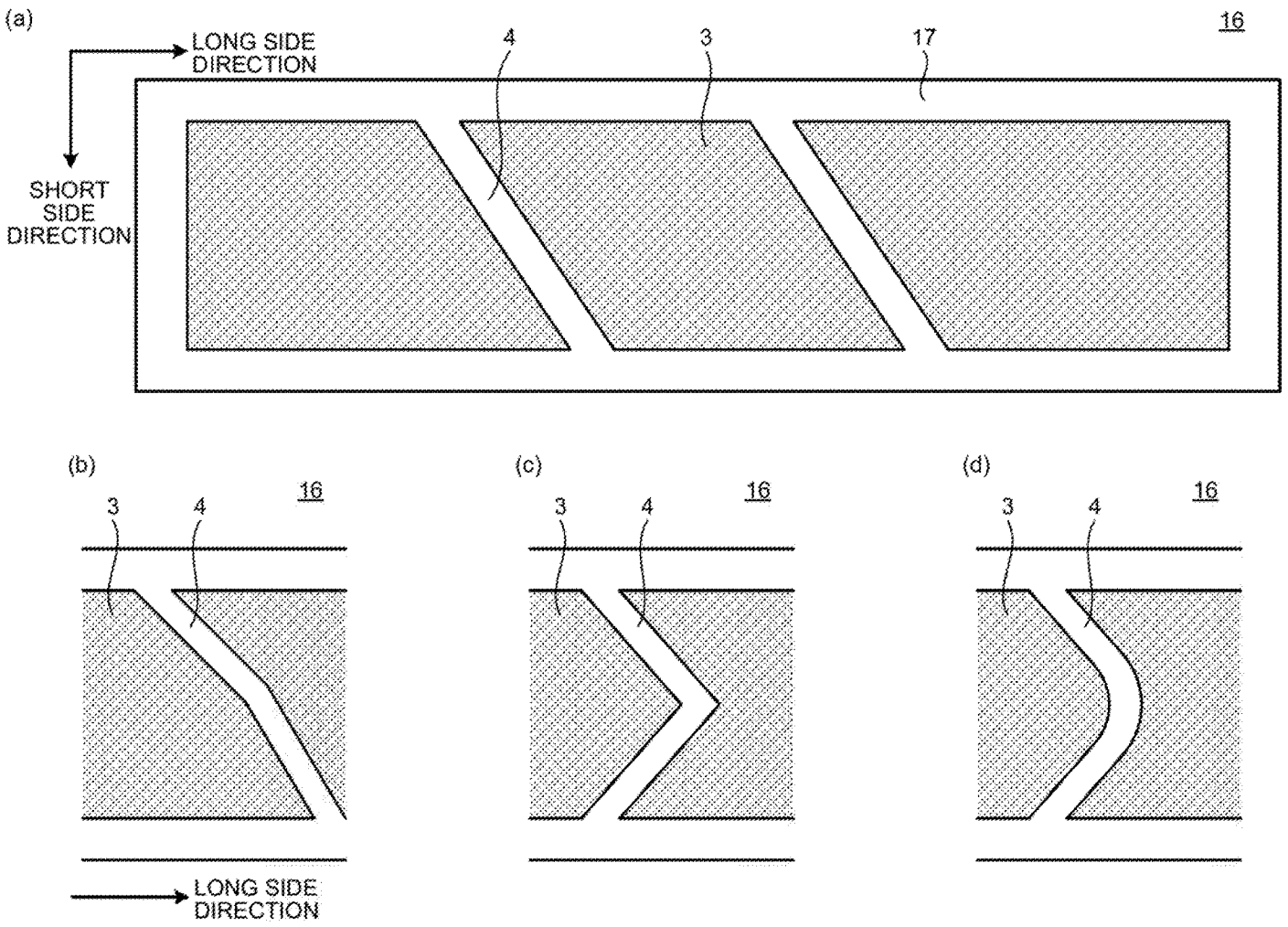
FIG. 6 are examples of arrangement forms of non-forming zones in the plate forming the spinneret of the present.
Figure 7:
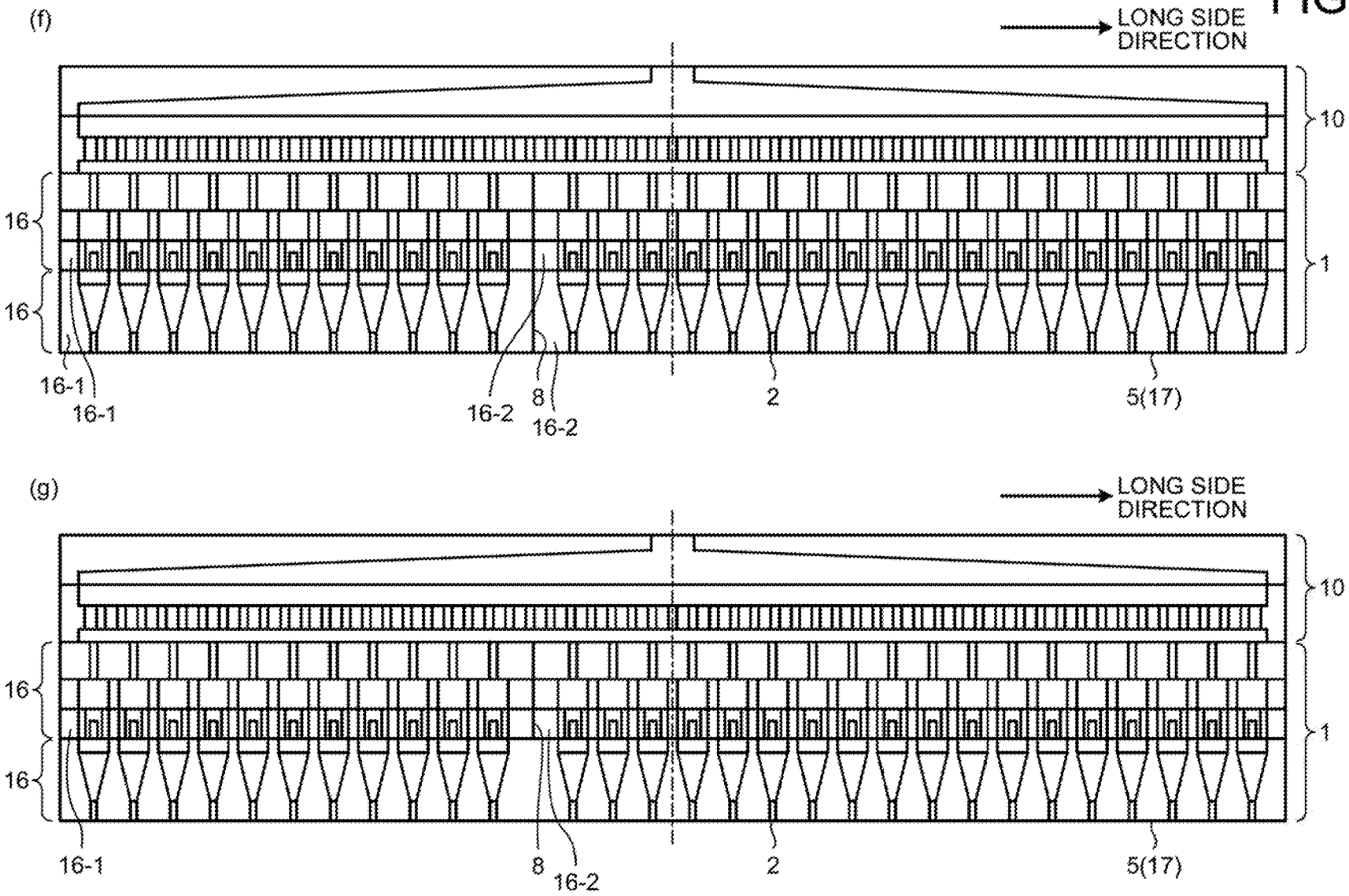
FIG. 7 are schematic cross-sectional views illustrating the spinneret of the present invention formed of a plurality of plates stacked one another, and illustrates examples of forms of a division line.

Refer to FIG. 6. FIG. 6 are views illustrating various embodiments of the non-forming zone 4. As illustrated in FIG. 6(*a*), there may be the one or more non-forming zones 4 in a rectangular area. When a plurality of the non-forming zones 4 are provided in a long side direction, the number of the divided plates 16 can be increased and a length of the one divided member can be shortened. In this case, the non-forming zones 4 are preferably arranged at equal intervals, but this arrangement of the non-forming zones 4 is not limited to this. In addition, as illustrated in FIG. 6(*b*), the non-forming zone 4 extends from one long side to the other long side, but may be bent in the middle position. As illustrated in FIG. 6(*c*), the non-forming zone 4 may be bent in the middle similarly to FIG. 6(*b*) and a direction toward a long side direction may be reversed. In addition, as illustrated in FIG. 6(*d*), the non-forming zone 4 may be curved. Furthermore, embodiments described above may be compositely combined.

Figure 8:
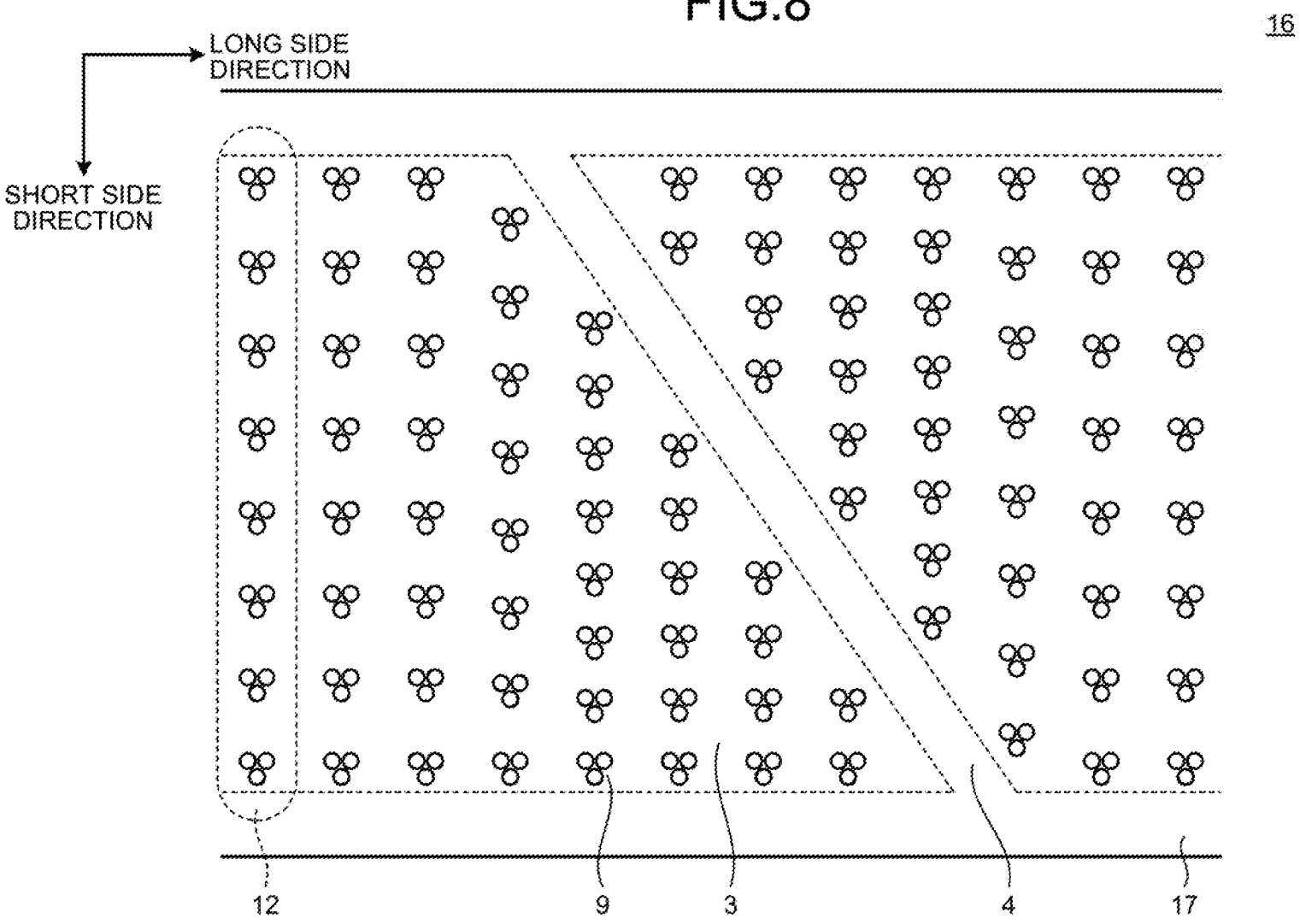
FIG. 8 is a schematic partial enlarged view illustrating the principal surface of another embodiment of the plate forming the first spinneret of the present invention.

Refer to FIG. 8. FIG. 8 is a view illustrating another embodiment of the plate 16. In the plate 16 of this embodiment, the nozzle hole 2 is a nozzle hole group 9 formed of multiple holes having a small hole diameter that are gathered. In FIG. 8, the nozzle hole group 9 is formed of three small nozzle holes that are gathered. However, there is no restriction of the number of small nozzle holes forming the one nozzle hole group 9.

The whole shape of the principal surface 17 of the plate 16 is preferably rectangular in conformity with a rectangular area on which the nozzle holes 2 are formed in the principal surface 17, but the whole shape is not limited to this, and may be polygonal.

A cross-sectional shape of the nozzle hole 2 is most preferably round in terms of discharge uniformity of a polymer and uniform measuring properties of a polymer, but the cross-sectional shape of the nozzle hole 2 is not limited to this, and may be a modified cross-sectional shape and a hollow cross-sectional shape other than a round shape. However, when the nozzle hole 2 has a cross-sectional shape other than a round shape, a length of the nozzle hole 2 in a polymer discharge direction is preferably made larger in order to ensure measuring properties of a polymer. In addition, all of the nozzle holes 2 preferably have the same shapes, but the shape of the nozzle holes 2 is not limited to this and the nozzle holes 2 may have shapes in which a round shape and a modified cross-sectional shape are mixed. In this case, a length of each nozzle hole 2 in a polymer discharge direction is preferably adjusted in order to adjust a discharge amount of a polymer discharged from the nozzle hole 2.

Second Spinneret

Subsequently, a second spinneret of the present invention will be described. The second spinneret is the same as the first spinneret except for the arrangement of the nozzle holes 2 in the nozzle hole rows with which the non-forming zone 4 intersects. Thus, characteristics of the first spinneret described above except for the different part can be directly applied to the second spinneret.

Refer to FIG. 9. On the principal surface 17 of the plate 16, the nozzle hole rows 12 each having the nozzle holes 2 aligned at regular intervals in a short side direction of a rectangle are aligned at regular intervals in a long side direction of the rectangle. In this rectangular area, the non-forming zone 4 where nozzle holes do not exist continuously extends from one long side of the rectangle to the other long side while intersecting with a plurality of the nozzle hole rows 12. In the nozzle hole row 12*b* with which the non-forming zone 4 intersects, if positions at which the nozzle holes 2 aligned at regular intervals are to be formed overlap with the non-forming zone 4, the nozzle holes 2 are not formed at the positions. As it is, the number of the nozzle holes 2 in the nozzle hole row 12*b* is less than the number of the nozzle holes 2 in the nozzle hole row 12*a* that do not intersect with the non-forming zone 4 by the number of nozzle holes 15 that are not formed. In the nozzle hole row 12*b* with which the non-forming zone 4 intersects, the nozzle holes 2 are supplied to the outside of the row by the number of the nozzle holes 15 that are not formed so as to be formed. In this manner, the number of the nozzle holes 2 in the nozzle hole row 12*b* with which the non-forming zone 4 intersects is the same as that of the nozzle holes 2 in the nozzle hole row 12*a* that do not intersect with the non-forming zone 4. Thus, the number of the nozzle holes 2 in all of the nozzle hole rows 12 can be made the same. In the second spinneret, the nozzle holes 2 are arranged at equal intervals in a short side direction over the whole rectangular area on the principal surface 17 of the plates 16 forming the second spinneret, so that a distance between yarns can be adjusted. Thus, even though swaying of yarns is generated by an air current of a cooling apparatus, yarns are prevented from contacting each other.

A fiber web discharged from the spinneret 1 is generally formed of a product part and selvage parts at both end parts of the product part that cannot be a product. Thus, the nozzle hole rows 12 at both end parts in a long side direction in a rectangular area where the nozzle holes 2 are formed on the principal surface 17 correspond to selvage parts of the fiber web, and the nozzle hole rows 12 other than the nozzle hole rows 12 at both end parts correspond to a product part. Because it is not necessary to strictly control the basis weight of a fiber and the like at the selvage parts, the number of the nozzle holes 2 in the nozzle hole rows 12 corresponding to the selvage parts may be less than the number of the nozzle holes 2 in the nozzle hole rows 12 corresponding to the product part. In the present invention, the nozzle holes 2 corresponding to the product part of the fiber web except for the both end parts in the rectangular area only have to satisfy the characteristic arrangement of the nozzle holes 2 of the plate 16 in the first and second spinnerets described above.

The present invention is an extremely versatile invention, and can apply to all fiber webs obtained by publicly known spinnerets and methods for manufacturing a fiber web. Thus, the present invention is not particularly limited to a polymer forming a fiber web. Examples of polymers forming a fiber web suitable for the present invention include polyester, polyamide, polyphenylene sulfide, polyolefin, polyethylene, and polypropylene. In addition, the polymers described above may include a matting agent such as titanium dioxide, silicon oxide, kaolin, a coloring protection agent, a stabilizer, an antioxidant agent, a deodorant, a flame retardant, a yarn friction-reducing agent, a color pigment, various kinds of functional particles such as a surface modifier, and additives such as an organic compound, and may include copolymerization without impairing spinning stability and the like.

A polymer used for the present invention may be formed of a single component and may be formed of a plurality of components. Examples of a plurality of components include the core/sheath formation and the side-by-side formation. A cross-sectional shape of a fiber forming a fiber web may be a circle, a triangle, a modified shape such as a flattened shape, and a hollow shape. Single yarn fineness of the fiber web is not particularly limited, but there is a clear difference between the present invention and the conventional technique as the single yarn fineness is smaller. The number of single yarns of a fiber web is not particularly limited, but there is a clear difference between the present invention and the conventional technique as the number of single yarns is increased.

A thickness of the fiber web obtained by the present invention is preferably 0.05 to 1.5 mm, more preferably 0.10 to 1.0 mm, and most preferably 0.10 to 0.8 mm. When a range of a thickness is within a range of 0.05 to 1.5 mm, the fiber web can have flexibility and proper cushioning properties.

The basis weight of the fiber web obtained by the present invention is preferably 10 to 100 g/m$^2$. A lower limit of the more preferable basis weight is 13 g/m$^2$ or more. When the basis weight is 10 g/m$^2$ or more, the fiber web having a practical mechanical strength can be obtained.

When a fiber web is produced using the spinneret of the present invention, a spinning speed is preferably 3,500 to 6,500 m/min, more preferably 4,000 to 6,500 m/min, and most preferably 4,500 to 6,500 m/min. When a spinning speed is defined as 3,500 to 6,500 m/min, the fiber web has high productivity.

EXAMPLES

The present invention will be described more concretely with examples. The following describes a method for measuring characteristic values in the examples and the like.

(1) Basis Weight of Fiber Web

A measurement was made based on JIS L1913 (2010) 6.2 "Mass per unit area". Three sheets of test pieces each measuring 20 cm×25 cm were sampled per 1 m width of a sample, and the respective masses (g) in normal states were measured, an average value thereof was represented by a mass (g/m$^2$) per 1 m$^2$.

(2) Basis Weight Coefficient of Variation (CV) (%) of Fiber Web

From a fiber web measuring 5 cm×5 cm, 16 samples were each taken in a longitudinal direction and a transverse direction, namely 256 samples in total. The mass of each sample was measured, an average value of the obtained values was converted per unit area, one decimal place thereof was rounded off, and the basis weight (g/m$^2$) of each sample was calculated. A coefficient of variation (CV) value (standard deviation/average value×100(%)) was calculated from the calculated value of the basis weight of each sample.

First Example

A fiber web was produced using the first spinneret formed of one sheet of the plate. The nozzle holes 2 bored in the plate 16 are arranged as illustrated in FIG. 4. In the nozzle hole row 12*a* with which the non-forming zone 4 does not intersect, each of the nozzle holes 2 is arranged in a lattice pattern. The nozzle holes 2 in the nozzle hole row 12*b* with which the non-forming zone 4 intersects are arranged at intervals narrower than those of the nozzle holes 2 in the nozzle hole row 12*a* with which the non-forming zone 4 does not intersect, and the 18 nozzle holes 2 are arranged in all of the nozzle hole rows 12. Arrangement density of the nozzle holes 2 per unit area in a rectangular area is 3.3 pieces/cm$^2$, and the diameter of each nozzle hole 2 is ϕ0.30 mm. The plate 16 includes the two non-forming zones as illustrated in FIG. 6(*a*), is divided into three in a long side direction by the division line on these non-forming zones, and an angle θ between the division line and a long side of a rectangle is 45 degrees.

Using this first spinneret, a polypropylene resin having a melt flow rate (MFR) of 35 g/10 min was melted by an extruder, and a yarn was spun with a single hole discharge amount of 0.56 g/min from the nozzle holes 2 at a spinning temperature of 235° C. After cooled and solidified by a cooling apparatus, the spun yarn was pulled and stretched by a pulling apparatus, and was collected on a moving net so as to obtain a fiber web formed of a polypropylene long fiber. The fiber diameter of the finally obtained long fiber was 16.1 μm, the basis weight of the fiber web was 18 g/m$^2$, and the CV value of the basis weight was 2.8%. As compared with a reference example in which a spinneret not having the after-mentioned division formation is used, the first example obtained the same basis weight CV value and achieved the best result.

Second Example

A fiber web was produced under the same spinning conditions as the first example except that the second spinneret formed of one sheet of the plate was used. The nozzle holes 2 bored in this plate 16 are arranged as illustrated in FIG. 9. In the nozzle hole row 12*a* with which the non-forming zone 4 does not intersect, the nozzle holes 2 are arranged in a zigzag pattern. In the nozzle hole row 12*b* with which the non-forming zone 4 intersects, the nozzle hole 2 is not formed on the part with which the non-forming zone 4 intersects, and the number (one piece) of the nozzle holes 2 that are not formed is formed so as to be supplied to the outside in a short side direction. The number of the nozzle holes 2 in the nozzle hole row 12, arrangement density of the nozzle holes 2 in a rectangular area, the diameter of each nozzle hole 2, the divided number of the plate 16, and an angle θ between the division line and a long side of the rectangle are the same as those of the first spinneret used in the first example.

The fiber diameter of the obtained long fiber was 16.1 μm, the basis weight of the fiber web was 18 g/m$^2$, and the CV value of the basis weight was 2.9%. As compared with the reference example in which the spinneret not having the after-mentioned division formation is used, the second example obtained the equivalent basis weight CV value and achieved the favorable result.

Third, Fourth, and Fifth Examples

In order to investigate an influence of an angle θ between a division line and a long side of a rectangle, third, fourth, and fifth examples were implemented. In the third example, using the same first spinneret as the first example except that an angle θ was 30 degrees, the spinneret was divided into two in a long side direction, and the 20 nozzle holes 2 were arranged in the one nozzle hole row 12, a fiber web was produced under the same spinning conditions as the first example. In the fourth example, using the same first spinneret as the first example except that an angle θ was 70 degrees, and the 14 nozzle holes 2 were arranged in the one nozzle hole row 12, a fiber web was produced under the same spinning conditions as the first example except that a single hole discharge amount was changed to 0.84 g/min. In the fifth example, using the same first spinneret as the first example except that an angle θ was 80 degrees, and the 10 nozzle holes 2 were arranged in the one nozzle hole row 12, a fiber web was produced under the same spinning conditions as the first example except that a single hole discharge amount was changed to 1.12 g/min.

In the third example, an angle θ was smaller than that of the first example and a distance of the non-forming zone 4 in a long side direction was longer. Thus, the divided number was reduced to two as compared with the first example.

In the fourth and fifth examples, an angle θ was larger than that of the first example and a range where the non-forming zone 4 and the nozzle hole row 12 overlapped with each other was increased. As the range where the non-forming zone 4 and the nozzle hole row 12 overlap with each other is increased, intervals between the nozzle holes 2 in a range where the non-forming zone 4 and the nozzle hole row 12 do not overlap with each other are narrowed by the increased overlapping range, but there is a restriction of processing, and there is a limit to narrow the intervals of the nozzle holes 2. Thus, if a range where the non-forming zone 4 and the nozzle hole row 12 overlap with each other is increased, the number of the nozzle holes 2 in the nozzle hole row 12 may be reduced. In the fourth and fifth examples, the number of the nozzle holes 2 arranged in the nozzle hole row 12 was reduced to 14 and 10, respectively, as compared with the first example. The arrangement density of the nozzle holes 2 per unit area was 1.8 pieces/cm$^2$ in the fourth example, and 1.0 piece/cm$^2$ in the fifth example. In the fourth and fifth examples having the arrangement density of the nozzle holes 2 lower than that of the first example, a polymer discharge amount of the spinneret 1 was reduced, and productivity was slightly low.

In the third example, the fiber diameter of the obtained long fiber was 16.1 μm, the basis weight of the fiber web was 18 g/m$^2$, and the CV value of the basis weight was 3.0%. In the fourth example, the fiber diameter of the obtained long fiber was 19.5 μm, the basis weight of the fiber web was 18 g/m$^2$, and the CV value of the basis weight was 3.0%. In the fifth example, the fiber diameter of the obtained long fiber was 22.8 μm, the basis weight of the fiber web was 18 g/m$^2$, and the CV value of the basis weight was 3.1%. As compared with the reference example in which the spinneret not having the after-mentioned division formation was used, the third and fourth examples obtained the equivalent basis weight CV values and achieved the favorable results. The fifth example had a basis weight CV value slightly inferior to that of the reference example, but achieved the favorable result.

Reference Example

Using the same spinneret as the first example except that the spinneret was formed of a plate having no non-forming zone on a principal surface, formed of one member, and not having a division formation, a fiber web was produced under the same spinning conditions as the first example. The fiber diameter of the obtained long fiber was 16.1 μm, the basis weight of the fiber web was 18 g/m$^2$, and the CV value of the basis weight was 2.8%.

This reference example obtained a fiber web of favorable variation in basis weight, but the plate did not have a division formation. Thus, a width of the plate was widened, production costs were increased, and the period required for production was prolonged.

Table 1 shows the results of the first to fifth examples and reference example.

TABLE 1

| | First example | Second example | Third example | Fourth example | Fifth example | Reference example |
|---|---|---|---|---|---|---|
| Divided or undivided | Divided | Divided | Divided | Divided | Divided | Undivided |
| Number of divisions | 3 | 3 | 2 | 3 | 3 | — |
| Number of nozzles in nozzle hole row | 18 | 18 | 20 | 14 | 10 | 20 |
| Angle θ [°] | 45 | 45 | 30 | 70 | 80 | — |
| Hole arrangement density [piece(s)/cm$^2$] | 3.3 | 3.3 | 3.3 | 1.8 | 1 | 3.3 |
| Basis weight CV value [%] | 2.8 | 2.9 | 3 | 3 | 3.1 | 2.8 |

Industrial Applicability

The present invention can apply to not only a pack for spinning used for a general melt-spinning method but also a pack for spinning used for a solution spinning method, but the application range is not limited to these packs.

REFERENCE SIGNS LIST

1 Spinneret
2 Nozzle hole
3 Forming area
4 Non-forming zone
5 Discharge surface
8 Division line
9 Nozzle hole group
10 Spinning pack
11 Porous plate
12 Nozzle hole row
**12*a*** Nozzle hole row that does not intersect with the non-forming zone
**12*b*** Nozzle hole row that intersects with the non-forming zone
13 Join line
14 Interval
15 Unformed nozzle hole
16 Plate
17 Principal surface of the plate
18 Part where the nozzle hole is skipped

The invention claimed is:

1. A spinneret comprising:

a plate including a plurality of nozzle holes formed therein; or a plurality of the plates stacked one another in a spinning direction, wherein, in at least one of the plates, the plurality of nozzle holes are formed in a substantially rectangular area on a principal surface, nozzle hole rows are aligned at regular intervals in a long side direction of the rectangular area, each of the nozzle hole rows including the plurality of nozzle holes aligned at regular intervals in a short side direction of the rectangular area, the rectangular area includes a non-forming zone that intersects with some of the nozzle hole rows, the non-forming zone continuously extending from one long side of the rectangular area to the other long side, and the non-forming zone including no nozzle holes, in each nozzle hole row with which the non-forming zone intersects out of the nozzle hole rows, at least one nozzle hole is not formed on a part where the non-forming zone intersects with a position of the regular interval at which the nozzle holes are aligned, and at least one nozzle hole corresponding to a number of the at least one unformed nozzle hole is additionally formed in a short side direction of the intersected nozzle hole row, and a number of nozzle holes in all of the nozzle hole rows is identical.

2. The spinneret according to claim 1, wherein the non-forming zone includes a division line.

3. The spinneret according to claim 1, wherein the plate including the non-forming zone is formed of two or more members joined together, and a join line at a join position of the adjacent two or more members on a principal surface of the plate overlaps with the non-forming zone.

4. The spinneret according to claim 2, wherein the division line is a straight line, and an angle between this line and a long side of the rectangle is a range between 30 to 70 degrees.

5. The spinneret according to claim 1, wherein the plate including the non-forming zone is formed by aligning two or more members at an interval, and the interval of the adjacent two or more members overlaps with the non-forming zone.

6. The spinneret according to claim 1, wherein each nozzle hole that is formed in the plate including the non-forming zone is defined as a nozzle hole group formed of a plurality of holes having a small hole diameter that are gathered, the small hole diameter being smaller than a diameter of each nozzle hole.

7. A method for manufacturing a fiber web, the method comprising manufacturing a fiber web using the spinneret according to claim 1.

8. A spinneret comprising:

a plate including a plurality of nozzle holes formed therein; or a plurality of the plates stacked one another in a spinning direction, wherein, in at least one of the plates, the plurality of nozzle holes are formed in a substantially rectangular area on a principal surface, nozzle hole rows are aligned at regular intervals in a long side direction of the rectangular area, each of the nozzle hole rows including the plurality of nozzle holes aligned in a short side direction of the rectangular area, the rectangular area includes a non-forming zone that intersects with some of the nozzle hole rows, the non-forming zone continuously extending from one long side of the rectangular area to the other long side, and the non-forming zone including no nozzle holes, in each nozzle hole row with which the non-forming zone does not intersect out of the nozzle hole rows, the nozzle holes are aligned at regular intervals, in nozzle hole rows with which the non-forming zone intersects out of the nozzle hole rows, intervals of at least a part of the nozzle holes in each of the intersected nozzle hole rows are narrower than intervals of the nozzle holes in the nozzle hole row with which the non-forming zone does not intersect, and a number of nozzle holes in all of the nozzle hole rows is identical.

9. The spinneret according to claim 8, wherein the non-forming zone includes a division line.

10. The spinneret according to claim 8, wherein the plate including the non-forming zone is formed of two or more members joined together, and a join line at a join position of the adjacent two or more members on a principal surface of the plate overlaps with the non-forming zone.

11. The spinneret according to claim 9, wherein the division line is a straight line, and an angle between this line and a long side of the rectangle is a range between 30 to 70 degrees.

12. The spinneret according to claim 8, wherein the plate including the non-forming zone is formed by aligning two or more members at an interval, and the interval of the adjacent two or more members overlaps with the non-forming zone.

13. The spinneret according to claim 8, wherein each nozzle hole that is formed in the plate including the non-forming zone is defined as a nozzle hole group formed of a plurality of holes having a small hole diameter that are gathered, the samll hole diameter being smaller than a diameter of each nozzle hole.

14. A method for manufacturing a fiber web, the method comprising manufacturing a fiber web using the spinneret according to claim 8.

* * * * *